United States Patent [19]

Brown

[11] 4,186,658

[45] Feb. 5, 1980

[54] APPARATUS FOR CONVEYING PARTICULATE MATERIAL

[75] Inventor: Douglas B. Brown, Ottawa, Canada

[73] Assignee: Stake Technology Ltd., Ottawa, Canada

[21] Appl. No.: 930,677

[22] Filed: Aug. 3, 1978

Related U.S. Application Data

[62] Division of Ser. No. 762,093, Jan. 24, 1977, Pat. No. 4,119,025.

[51] Int. Cl.[2] ..... B30B 9/38; B30B 11/24

[52] U.S. Cl. ..... 100/148; 100/145; 100/191

[58] Field of Search ..... 100/35, 37, 41, 117, 100/144, 145, 147, 148, 150, DIG. 3, DIG. 5, DIG. 8, DIG. 9, 137–139, 191, 192; 425/204, 207, 376

[56] References Cited

U.S. PATENT DOCUMENTS

| | | | |
|---|---|---|---|
| 797,374 | 8/1905 | Roberts | 100/148 |
| 2,554,082 | 5/1951 | Anderson | 23/290.5 |
| 3,054,343 | 9/1962 | Pellett | 100/148 |
| 3,323,444 | 6/1967 | Mark et al. | 100/DIG. 5 |
| 3,621,775 | 11/1971 | Dedio | 100/191 |
| 3,752,066 | 8/1973 | Charles | 100/35 |

FOREIGN PATENT DOCUMENTS

| | | | |
|---|---|---|---|
| 61101 | 7/1943 | Denmark | 100/DIG. 5 |
| 16309 | 10/1911 | United Kingdom | 100/145 |

*Primary Examiner*—Peter Feldman

*Attorney, Agent, or Firm*—Cushman, Darby & Cushman

[57] ABSTRACT

Apparatus for conveying particulate material of the type wherein it is desired that the material be simultaneously pre-compacted from a generally loose state to a more or less solid "plug" state. A screw conveyor is arranged to deliver loose particulate material to an intermediate chamber at the end of the screw conveyor means wherein the material is pre-compacted by the action of the screw conveyor. Following the intermediate chamber, a piston reciprocating coaxially with the screw conveyor further urges the material in a direction coaxial with the centerline of the screw conveyor to further advance the material through a straight coaxial conduit within which the material becomes compacted to an increased degree of compactness, solely by the action of the reciprocating piston. The reciprocating piston has preferably an annular face, whose outside diameter is generally the same as that of the I.D. (inside diameter) of the conduit. The second, high degree of compactness is thus achieved solely by the action of the piston. Accordingly, the mounting of the screw conveyor is not subjected to extreme forces. The device is capable of compacting, for instance, fibrous material of a relatively low fibre shear strength to an extremely high compactness without exceeding the fibre shear limit in the area of the screw conveyor. Frictional drag in the conduit following the apparatus may be increased by vanes protruding inside of the conveyor. The depth of the friction increasing vanes may be selectively adjustable.

3 Claims, 9 Drawing Figures

APPARATUS FOR CONVEYING PARTICULATE MATERIAL

This is a division of application Ser. No. 762,093 filed Jan. 24, 1977, now U.S. Pat. No. 4,119,025.

The present invention relates to an apparatus for conveying a mass of particulate material from a feeding hopper to a region of processing of said material. The invention is concerned with the above method and apparatus of the type including the steps of conveying said material deposited from said hopper, by screw conveyor means, and further advancing the material to a conduit communicating said conveyor means with said region of processing, also referred to as "processing means".

The apparatus according to the present invention is particularly related, but not necessarily limited sto the field similar to that disclosed in Canadian patent No. 636,473 issued Feb. 13, 1962 to N. H. Sandberg and entitled "Apparatus for Continuous Pulp Preparation". Another field of potential application of the present invention may be in feeding coal dust to a furnace, etc.

In many applications of the above type of apparatus it is desirable that the conveyed material be compacted by the action of the conveying means to a very high degree of compactness. For instance, in the co-pending United States patent application Ser. No. 762,094, filed Jan. 24, 1977, now abandoned, of which the applicant herewith is a coinventor, filed on the same date and entitled "Method of Feeding Fibrous Material into a Pressurized Vessel", a method of feeding of an organic fibrous material into a digester is disclosed which includes the step of compacting the fibrous material to the density of at least 45 pounds per square foot. Another frequent requirement in operation of devices of this kind is that there be maintained a continuity of the material which is already in a highly compacted state, with the rest of the material advancing from a hopper through a screw conveyor to the compacted "plug" of the material.

Simultaneous conveying and compacting of a fibrous material is disclosed for instance in the above mentioned Canadian patent No. 636,473, wherein a tapering conveyor screw forces wood chips through a tapered chamber compacting the chips into a solid plug and forcing them into a relatively small diameter orifice leading to an impregnating chamber. The drawback of such arrangement is that the eventual compactness of the conveyed material, effected solely by the screw conveyor combined with the friction in subsequent narrowing sections of a conduit, is limited by the average shear strength of the material. This consideration is of essence when working with low strength materials such as bagasse, straw or the like.

If the compactness of the eventually formed "plug" is too high, the shear strength value in the screw conveyor area becomes exceeded with the resulting separation of the conveyed material surrounding the core of the screw of the conveyor and the annular layer located outside of the helix of the conveyor, whereby the conveyor ceases to advance the matter.

On the other hand, even when operating with relatively strong material, such as hardwood chips or the like, the compacting of the "plug" requires relatively high energy for driving the screw conveyor, a robust structure of the screw of the conveyor, of its bearings and of the overall arrangement of the screw conveyor portion of the feeding device resulting in relatively high costs both from the standpoint of the price of the machine and from the standpoint of maintenance.

It is also known, e.g. from U.S. Pat. No. 3,865,528 issued on Feb. 11, 1975 to R. G. Roess, to aggregate a screw conveyor with a piston feeding device, in the field of injection moulding of plastics material. The basic drawback of this arrangement from the standpoint of a generally universal application is in that the screw conveyor feeds particulate plastics material into a conduit which communicates, in a radial direction, with an axially offset chamber provided with a piston further forcing the particulate material to the mould of the machine. Such arrangement is operable only if the conveyed material is in a molten state before reaching the piston chamber. Accordingly, the latter arrangement is suitable only for plastics material wherein the conveyed matter is in a liquid form generally throughout the entire conveying path. The arrangement of this type would be totally unsuitable for applications such as the feeding of pressurized digesters with organic material such as woodchips, straw, bagasse or the like.

It is an object of the present invention to overcome the above drawbacks of prior art by providing a new and useful apparatus of the above mentioned type.

According to the present invention, an apparatus is provided for feeding a mass of material, comprised of solid particles from hopper means to means for processing of said material. The apparatus comprises in combination:

(a) screw conveyor means for advancing said mass in a generally axial direction away from said hopper means, towards an inlet of a tubular conduit, the outlet of said conduit being in a permanent communication with said processing means, said conduit extending generally coaxially with said conveyor means;

(b) an intermediate chamber at the discharge end of said conveyor means generally coaxial therewith, said intermediate chamber being located between said conveyor means and said conduit means and normally being in a communication therewith;

(c) reciprocating piston means having a forward face and disposed at said intermediate chamber for a reciprocating movement generally coaxially with said screw conveyor means said forward face of said piston means being turned towards said processing means;

(d) first drive means for rotating said screw conveyor and second drive means for reciprocating said piston means.

Thus, the conveyor means is capable of advancing the mass to the intermediate chamber means, while subsequent advance of said mass through the conduit is effected solely by the compressive action of the piston means.

In a first preferred embodiment of the present invention, the piston means is an annular piston whose outside diameter generally corresponds to the inside diameter of the conduit, the inside diameter of the piston generally corresponding to the outside diameter of the screw conveyor means, the discharge end of said screw conveyor means being telescopically received inside said annular piston. This preferred embodiment is particularly suitable for maintaining the material conveyed throughout the entire system in a continuous mass which is highly desirable, particularly when applying the present invention in the art of feeding pressurized vessels such as digesters with organic fibrous material, e.g. straw, bagasse, etc.

In another preferred embodiment of the present invention, the intermediate chamber is a generally frustoconical chamber coaxial with said screw conveyor means. The chamber has a major base end portion facing the screw conveyor means and being of a diameter generally corresponding to the outside diameter of the screw conveyor means. The chamber further has a minor base section facing the conduit means and being of a diameter generally identical to the inside diameter of the conduit means. In this second embodiment, the face of the piston means is a solid, circular face with a circular depression in the centre thereof, to provide for an annular forwardmost face section.

Both of the above preferred embodiments of the apparatus are thus capable of operating in accordance with the method of the present invention, said method being of the type including the steps of conveying said material from the outlet region of a hopper by screw conveyor means, and further advancing the material through a conduit communicating said conveyor means with said region of processing. The method further includes the steps of:

(a) subjecting said mass to a force generated by said screw conveyor means, said force being directed in an axial direction along a generally straight line, while simultaneously compacting said mass to a first degree of compactness, said first degree of compactness being achieved in a first region adjacent to and including a discharge area of said screw conveyor means, said first degree of compacting being achieved by the action of said screw conveyor means combined with frictional drag acting on said mass at said discharge area due to accumulation of said mass in said first region;

(b) discharging said mass from said first region into a second region, said second region being axially spaced downstream of said first region and being generally coaxial therewith;

(c) subjecting a portion of said mass located at said second region to an intermittent force directed to further advance said mass away from said first region in a direction generally coaxial with the contreline of said conveyor means;

(d) subjecting the mass located downstream of said second region to a force frictionally retarding the mass relative to said intermittent force to thus further compact said mass to a second degree of compacting, said second degree of compacting being in excess of said first degree of compacting;

(e) further advancing the mass compacted to said second degree of compactness to said region of processing along a generally straight line coaxial with the centreline of said screw conveyor means, whereby a portion of said mass assumes the shape of a continuous, compacted plug corresponding in cross-section to the cross-section of said conduit; and (f) discharging the leading end of said mass from said conduit into a processing means while maintaining said conduit in a permanent communication with said region of processing.

The present invention will now be described in a greater detail with reference to the accompanying simplified drawings.

Figure 1:
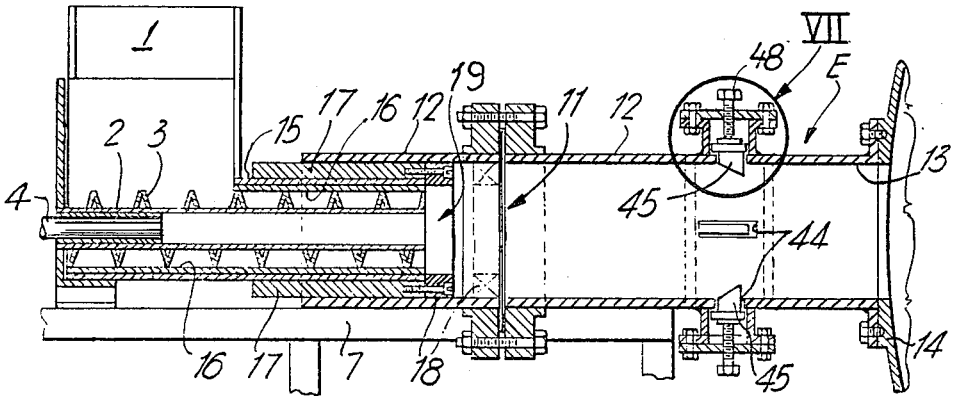
FIG. 1 is a partial, sectional view of a first embodiment of the present invention as applied to an apparatus for feeding a pressurized vessel.

Turning now to FIG. 1, reference numeral 1 designates the bottom outlet 1 of a hopper (not shown) located above one end of a screw 2 of a conveyor, the screw having usual continuous helix 3 extending the entire length of the screw. As best seen from FIGS. 2 and 3, the screw 2 is fixedly secured to one end of a shaft 4 supported by bearings mounted in bearing housings 5, 6 which are fixedly secured to a base frame 7. The opposite end of shaft 4 terminates in a gear box 8, whose input is driven by a V-belt drive 9 (FIG. 3) operatively associated with a drive motor 10.

The opposite end of the screw 2 terminates in proximity to an inlet portion 11 (FIG. 1) of a conduit 12, the outlet portion 13 of conduit 12 terminating at a pressurized digester 14. It will be appreciated from FIG. 1, that the conduit 12 is maintained in a permanent communication with the interior of digester 14. The term, "permanent communication" in this context means that the apparatus according to the present invention does not constitute any valve or the like separating the outlet 13 of the conduit from the hopper.

The conveyor screw 2 is mounted for rotation within a tubular section 15 whose interior is provided with four axially elongated ribs 16 which are normally maintained in sliding contact with the periphery of the helix 3 as shown in FIG. 1. The exterior of tubular section 15 slidably receives an axially elongated, annular piston 17 which is free to move in axial direction back and forth on the outer side of tubular section 15.

The end of piston 17 is provided with an annular ring 18, the interior of ring 18, together with the adjacent portions of the interior of piston 17 forming an intermediate chamber 19. The intermediate chamber is located between the end of the conveyor screw 2 and the inlet 11 of the conduit 12.

It will be appreciated from the above that, in general terms, screw conveyor means (2, 3, 15, 16,) is arranged for advancing a mass of material in a generally axial direction away from the region of the outlet of hopper means towards an inlet 11 of a tubular conduit 12, the outlet of said conduit being in a permanent communication with processing means, the processing means in the embodiments shown being the digester 14. It is clearly seen from FIGS. 1, 2 and 3 that the conduit 12 extends generally coaxially with the above mentioned conveyor means. The foregoing description also shows, with reference to FIG. 1, an intermediate chamber 19 at the discharge end of said conveyor means, the chamber 19 also being generally coaxial with the conveyor means and being located between the conveyor means and said conduit means. The chamber 19 is normally in communication with the conveyor means and also with the conduit.

The above ring 18 forms the forward face of the annular piston 17 turned towards the digester 14. In general terms, the reciprocating piston means (17,18) has a forward face disposed at the intermediate chamber 19 for a reciprocating movement generally coaxially with the screw conveyor means with the forward face of said piston means being turned towards the processing means.

The assembly of the shaft 4, of the gear box 8, drive 9 and the motor 10 are also referred to as "first drive means for rotating said screw conveyor".

Figure 2:
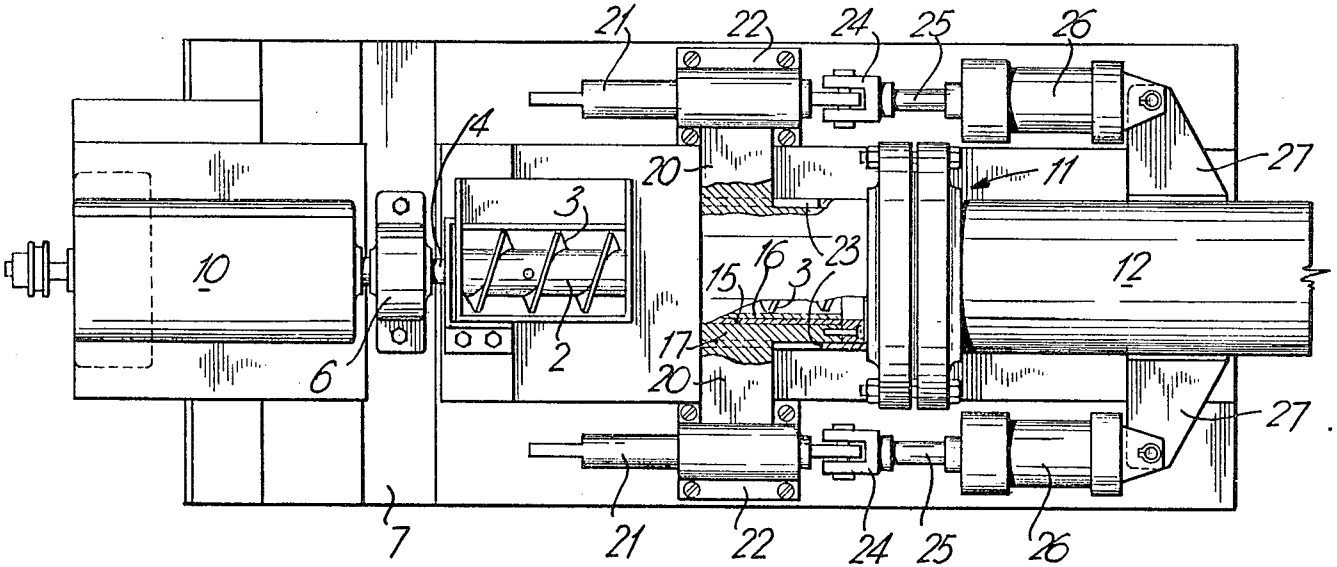
FIG. 2 is a plan view of the embodiment of the device of FIG. 1 showing further elements thereof.
Figure 3:
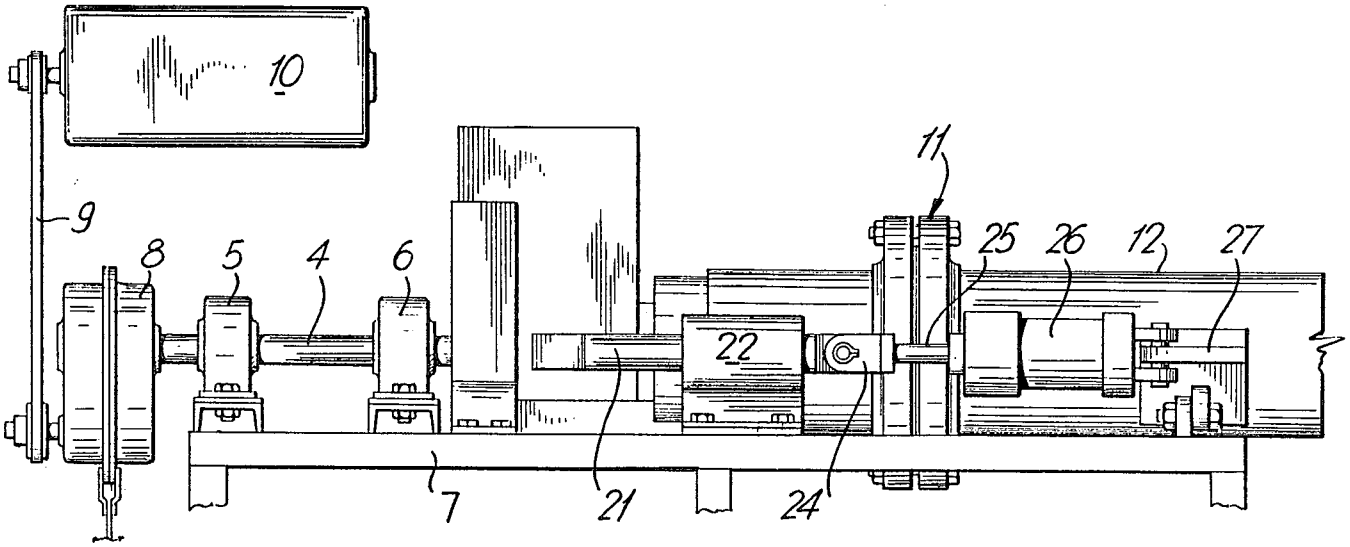
FIG. 3 is a side elevation of FIG. 2.

Turning now to FIG. 2, fixedly secured to the exterior of piston 17 and extending horizontally radially from each side thereof is a boss 20 the radially outside end of each of the bosses 20 being fixedly secured to a portion of a rod 21 slidably received in a housing 22, which is fixedly secured to base frame 7. Each of the bosses 20 protrudes through a horizontally elongated slot 23 (bottom of FIG. 2) provided in the side of the tubular section 15 housing the piston 17. One end of each of the rods 21 is connected, over a flexible joint 24, with a piston rod 25 of a hydraulic cylinder 26, the opposite end of each of cylinders 26 being pivotally secured to a bracket 27 fixed to the base frame 7.

Figure 8:
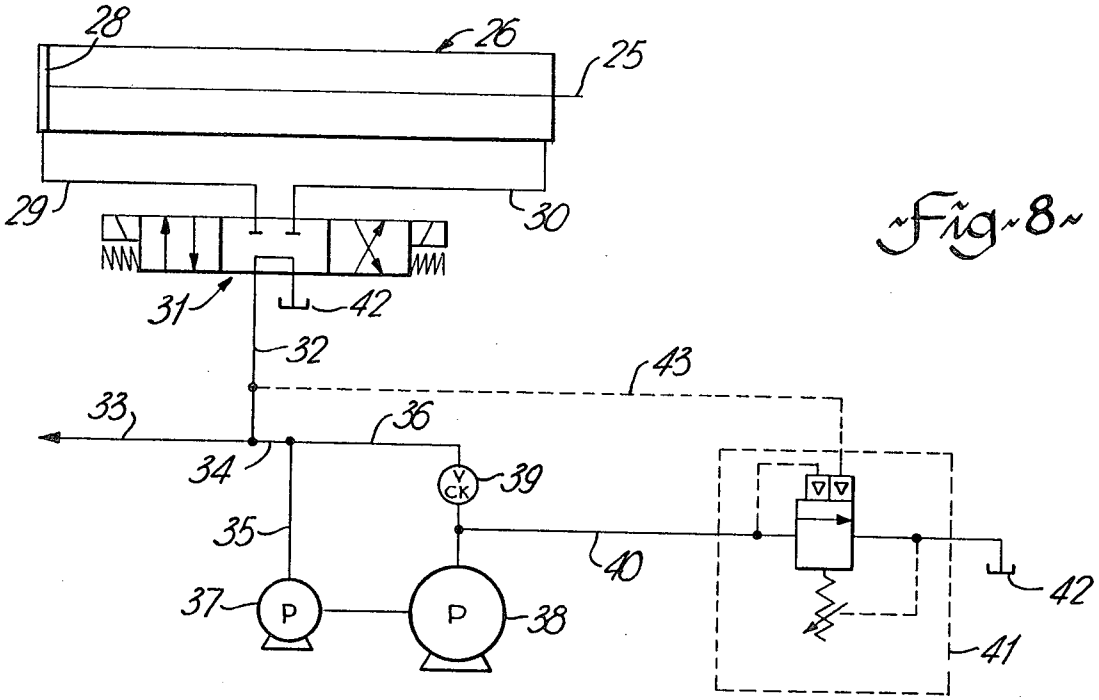
FIG. 8 is a simplified hydraulic diagram showing the preferred embodiment of drive means for the compacting pistons of the present invention.

Referring now to the diagrammatic drawing of FIG. 8, the cylinder 26 is provided with a piston 28. One end of the interior of the cylinder 26 communicates with a line 29, the opposite end of the cylinder 26 communicating with a line 30. The opposite ends of lines 29, 30 are connected to the output end of a control valve 31. The opposite end of the control valve 31 is connected to a further line 32 which, in turn, communicates with a safety discharge branch 33 and with a drive branch 34. The branch 34 is divided into a low volume, high pressure line 35 and with a high volume, low pressure line 36, the lines 35 and 36 communicating with a high pressure, low volume pump 37 and with a low pressure, high volume pump 38, respectively. The line 36 is provided with a check valve 39. A discharge conduit 40 provided with a pilot valve 41 communicates a portion of line 36 between the check valve 39 and the pump 38 with a sump 42. The pilot valve 41 is operatively connected with a pilot line 43 which is in communication with the line 32 referred to above. The control valve 31 is selectively adjustable to communicate line 32 with the sump 42. The system of each of the cylinders 26 and of the associated hydraulic system as referred to in FIG. 8, can also be referred to in general terms as second drive means for reciprocating said piston means.

The operation of the described portions of the first embodiment of the apparatus is as follows:

A switch (not shown) of the motor 10 is actuated to activate the motor 10 simultaneously with the drive of pumps 38 and 37. The pilot valve 41 is now closed. The fluid delivered by pumps 37, 38 flows via line 32 to the control valve 31 and back into sump 42. On actuation of the control valve 31, the flow is directed from line 32 to line 29, while line 30 now communicates with sump 42. The pressurized fluid drives piston 28 to the right-hand side. Once the piston reaches its position opposite to that shown in FIG. 8, the control valve 31 is reversed to communicate line 32 with line 30 and line 29 with sump 42. Accordingly, the pressurized fluid delivered by pump 37 and 38 now drives the piston 28 from the right-hand side to the left-hand side, as viewed in FIG. 8. The frequency of the reciprocating motion of the piston 28 and thus of the hollow piston 17 is in the range of approximately one stroke per second.

Accordingly, with the first and second drive means being actuated, the screw 2 rotates to deliver the material, for instance straw or bagasse, from the outlet 1 of the hopper towards the chamber 19 at the outlet end of the conveyor screw 2. The material, while conveyed by the screw, is simultaneously compacted by the action of the screw and accumulates in the region of chamber 19, to further advance to the right of FIG. 1 into the inlet 11 of the conduit 12. The material eventually fills in the entire cross-section of the conduit 12 and is further advanced by the reciprocating motion of the hollow piston 17 whose end ring 18 axially pushes the accumulated mass towards the digester 14. The friction at the interior wall of conduit 12 combines with the advancing action of the piston in further compacting of the material which, eventually, forms a plug whose density is considerably increased in comparison with the density present at the chamber 19 at which the material leaves the screw conveyor area. It will thus be appreciated that the advancement of the compacted mass through the conduit 12 is effected solely by the action of reciprocating hollow piston 17, while the screw conveyor 2 continously delivers further material to be compacted by the hollow piston.

Figure 9:
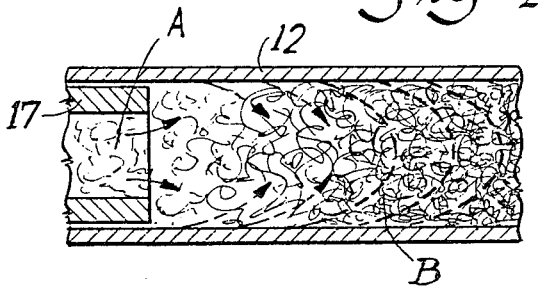
FIG. 9 is a diagrammatic view of the hollow piston and conduit, and discloses the compacting of the fibrous material with the lines of stress developing therein.

The action of the reciprocating piston is shown in a diagrammatic way in FIG. 9, in which an area A shows fibrous material in a pre-compacted state, advancing, due to the action of the screw conveyor (not shown in FIG. 9) to the right-hand side into the conduit 12. The reciprocating piston 17 further compacts the material to a relatively high degree of compactness of more than 45 pounds per cubic foot, which is achieved at area B of the conduit 12. Due to the annular shape of the face of piston 17, and due to the advancement of the material through the conduit 12, the lines of stress within the compacted mass assume an arcuate shape as shown, thus contributing to the beam strength of the compact plug at B, which is of advantage from the standpoint of the plug capability to effectively prevent blow-back within the system.

It will be appreciated that in general terms, the degree of compacting of said mass by the action of the screw conveyor 2 may also be referred to as "a first degree of compactness." In general terms, the mass of the conveyed material may be said to be discharged from a discharge area of said screw conveyor (chamber 19) into a second region (inlet 11) which is axially spaced downstream of said first region. Furthermore, in general terms, the portion of the conveyed mass located in the second region, or at inlet 11, is subjected to an intermittent force (generated by the hollow piston) and directed to further advance the mass away from the first region (i.e. from chamber 19) in a direction generally coaxial with the centreline of the screw conveyor means.

It is also apparent from the above description that the mass located downstream of the inlet 11 (also referred as "the second region") is subjected to a force frictionally retarding the surface of said mass relative to said intermittent force to assist in the compacting of the mass. This frictional force acts at the interior wall of the conduit 12. Thus, the mass advancing through conduit 12 is compacted by the action of the piston 17 to a second degree of compacting which is in excess of the first degree of compacting effected solely by the action of screw conveyor. It will be appreciated that the second degree of compacting does not subject the conveyor screw 2 to any stress additional to that necessary for conveying and precompacting the material delivered to the chamber 19. Accordingly, the overall assembly of the screw conveyor does not have to be unnecessary bulky. Furthermore, the mechanism of the screw conveyor is not subject to an excessive wear during the operation.

Figure 7:
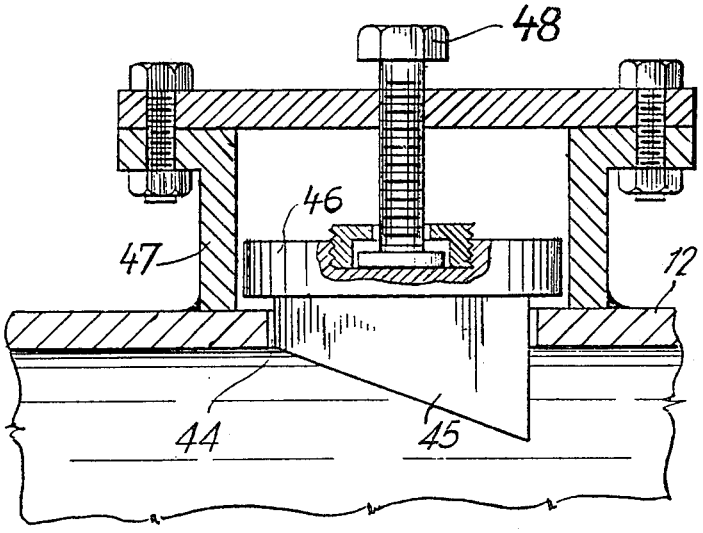
FIG. 7 (on the sheet of FIG. 1) is a detailed sectional view of detail VII of the conduit associated with the apparatus as shown in FIG. 1.

Referring now to the right hand side of conduit 12 as shown in FIG. 1 and also referring to FIG. 7, the frictional retarding force and thus the compactness of the material within the conduit 12 may be selectively adjusted by a device whose one, preferred embodiment will now be described in greater detail.

As shown in the two figures, the conduit 12 is provided with four axially elongated slots 44, each receiving, in a close sliding fit, a generally flat vane member 45 secured to a base 46 sliding in an annular ring 47. Each of the vanes 45 is operatively associated with a set screw 48. Accordingly, the manipulation of the set screw 48 governs the depth of penetration of the respective vane 45 into the conduit. The deeper the penetration of vane 45, the greater frictional retarding force; accordingly, the vanes are capable of selectively controlling the second degree of compactness of the material.

Eventually, the compactness of the material within the conduit 12 reaches a considerable density figure. For instance, it was found that in conveying straw or bagasse, the density in the region of vanes 45 eventually reaches the figure of about 45 pounds per cubic foot. Such density could not be obtained solely by the action of the conveyor screw, as the back pressure of the accumulated material would result in exceeding of the shear strength of the fibres of the conveyed material.

Referring now to FIG. 8 in conjunction with FIG. 1 and with the above-disclosed compacting of the material to form a "plug" within the conduit 12, it will be appreciated that the pressure which the ring 18 of the hollow piston 17 has to overcome gradually increases. This increase results in an increased pressure within the line 32. Eventually, the increased pressure in line 32 forces the check valve 39 to close. At the same time, the pressure is transferred via pilot line 43 to the pilot valve 41 which opens line 40 to direct the fluid driven by the high volume-low pressure pump 38 to sump 42. At this moment it is only the low volume-high pressure pump 37 which operates the piston 28 of each of the cylinders.

Figure 4:
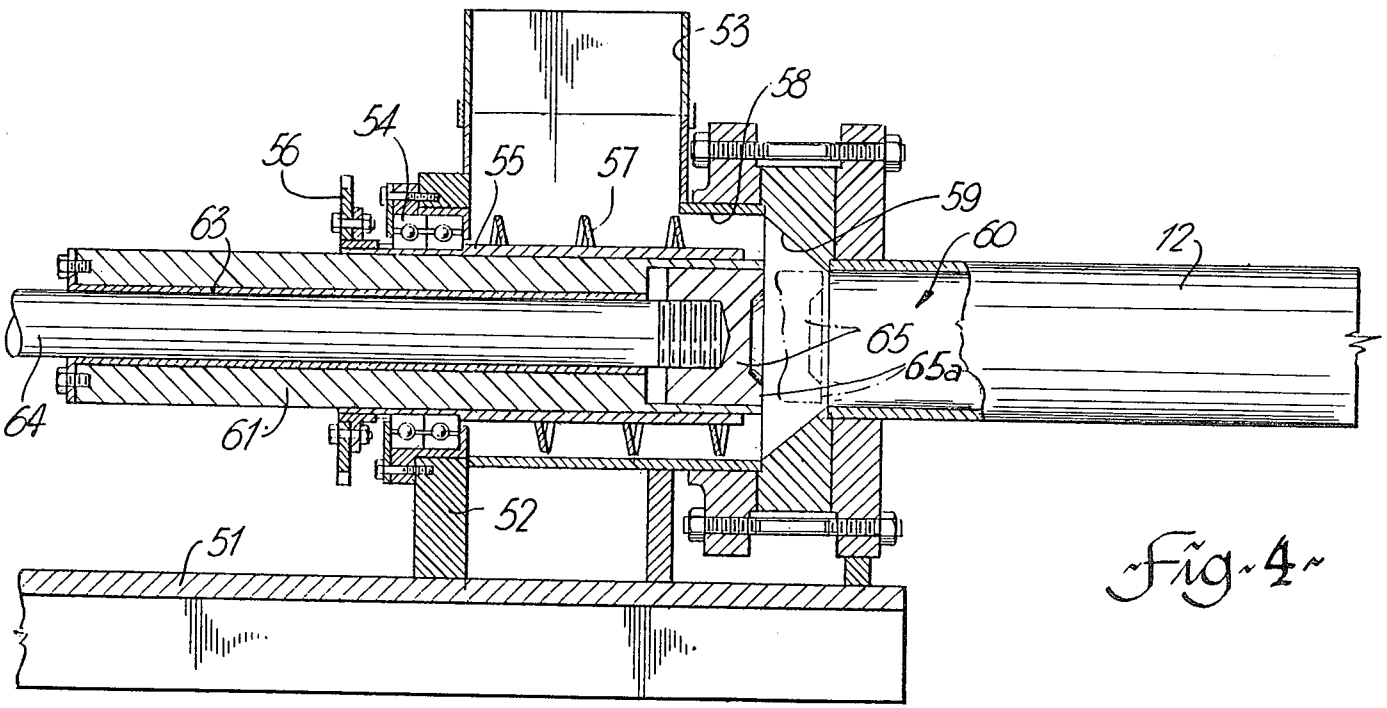
FIG. 4 is a partial, sectional view of a second embodiment of the apparatus according to this invention.
Figure 5:
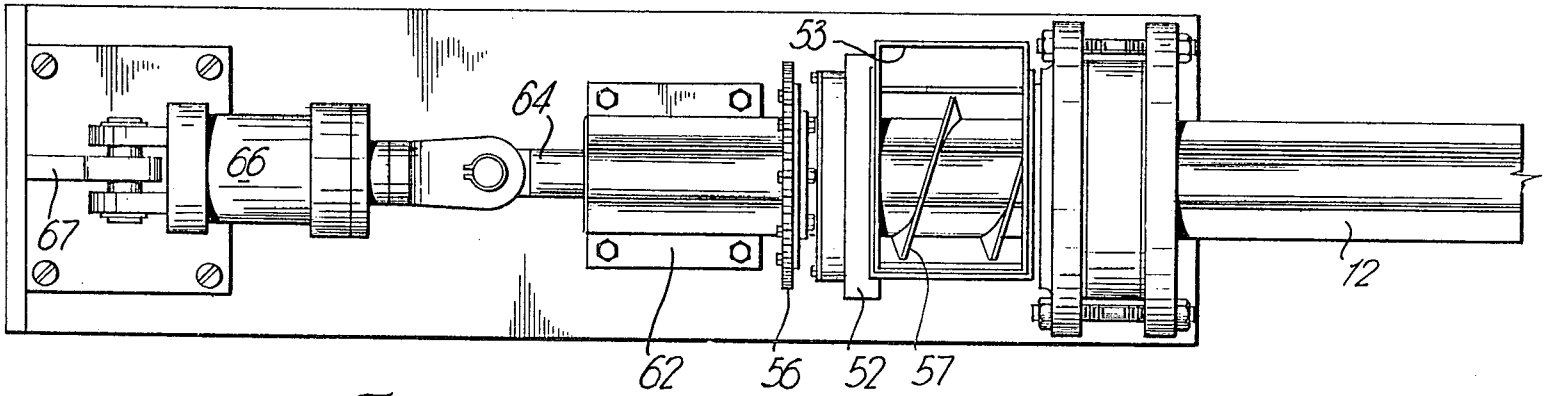
FIG. 5 is a plan view of the apparatus as in FIG. 4, showing further detail thereof.
Figure 6:
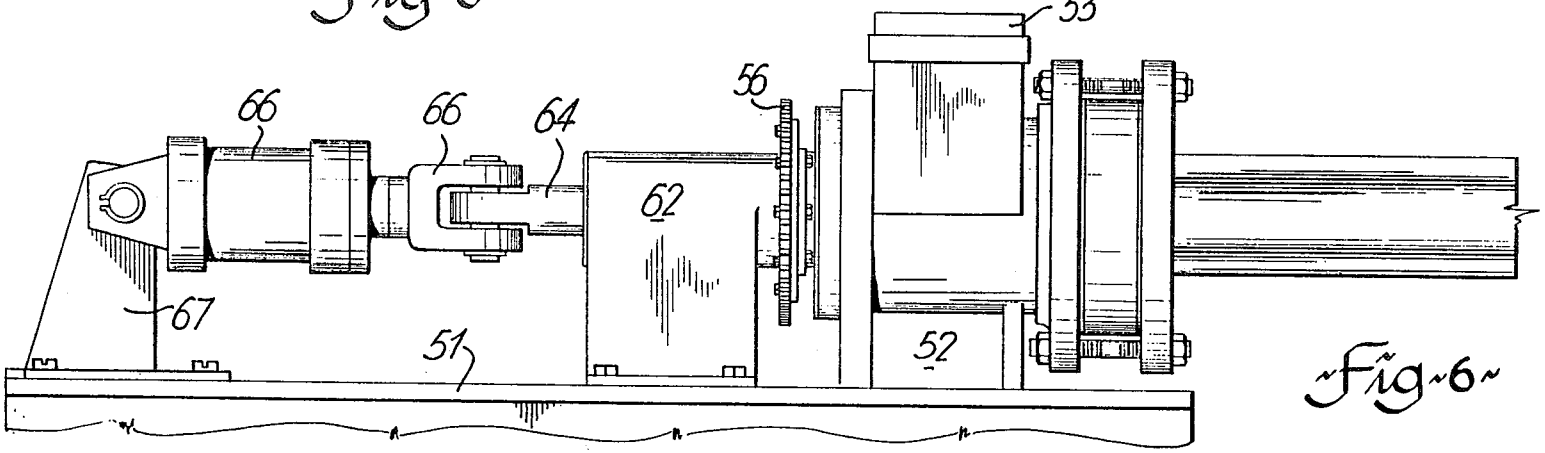
FIG. 6 is a side elevation of the apparatus shown in FIG. 5.

Another embodiment of the present invention will now be described with reference to FIGS. 4, 5 and 6, it being understood that FIGS. 4, 5 and 6 show an apparatus associated with a conduit 12 which is of a structure generally similar to that shown in FIG. 1, the conduit 12 in FIGS. 4–6 being indicated in a part only. Fixedly secured to a base 51 is a support 52 whose upper portion forms an inlet 53 normally communicating with the bottom of a hopper (not shown). As seen from FIG. 4, a set of bearings 54 is mounted within the support 52 for rotatably mounting a sleeve 55 whose left hand side is provided with a sprocket gear 56 for driving the sleeve 55. The sleeve 55 is provided with a continuous helix 57 to form a conveyor screw as best seen from FIG. 4. The free end of the conveyor screw reaches into a tubular chamber 58, the chamber 58 and the helix 57 thus forming screw conveyor means of a known configuration. The chamber 58 merges with a frusto-conical chamber 59. As seen from FIG. 4, the merger between chambers 58 and 59 is at a major base section of the frusto-conical chamber 59. The minor base end of frusto-conical chamber 59, in turn, merges with the inlet portion 60 of the conduit 12.

The sleeve 55 is arranged to rotate on a core sleeve 61, mounted in a housing 62 fixedly secured to the base 51 as seen in FIGS. 5 and 6. Extending through the centre of the core sleeve 61 is a lining 63 surrounding a portion of a piston rod 64, the piston rod 64 being slidable relative to the lining 63. The free end of piston rod 64 is secured to a piston 65 facing towards the inlet 60 the face of the piston being recessed as shown, to provide an annular forwardmost face section 65*a*.

As shown in FIGS. 5 and 6, the opposite end of the piston rod 64 is secured to a joint 66 which forms the end of the piston rod of a hydraulic cylinder 66, the cylinder 66 being secured to a bracket 67.

The operating mechanism of cylinder 66 is identical to that of any of the cylinders 26 as referred to hereinabove.

Accordingly, it will be appreciated that on actuation of a first drive means (not shown in FIGS. 4–6), the sprocket gear 56 drives the conveyor 57. At the same time, the hydraulic cylinder 66 reciprocates the piston 65 in back-and-forth fashion, the extreme extended position being shown in dotted lines in FIG. 4. The material to be conveyed is delivered from the inlet 53, to be further advanced by the screw conveyor through the tubular chamber 58 and then pre-compacted due to the tapering shape of chamber 59 to a first degree of compression. The pre-compressed material reaches the area of inlet 60 of the conduit 12 and is further advanced solely by the reciprocating action of piston 65.

It will be appreciated that, in general terms, the operation of the second embodiment is similar to that of the first embodiment, however, in the second embodiment of FIGS. 4–6, the compacting of the material to the second degree of compactness is effected by a piston which is solid rather than annular as in the first embodiment.

The second embodiment of the apparatus is particularly suitable for applications wherein it is less essential that a continuity of fibrous material coming through the inlet 53 be maintained with the compacted "plug" within the conduit 12. The second embodiment is simpler to produce as it has only a single hydraulic cylinder 66 as opposed to two or even more hydraulic cylinders normally required in the first embodiment.

Those skilled in the art will readily conceive further modifications of the present invention. For instance, the friction increasing vanes 45 need not necessarily be adjustable. Indeed, it has been found out that in certain application, they need not be present in the conduit 12 as the sole friction of the interior of the walls of conduit 12 provides sufficient retarding force necessary for the compacting. A readily conceivable alternative to the vanes 45 would be simply a longer conduit 12 as, obviously, the degree of frictional drag increases with the compactness of the material.

Furthermore, the arrangement of the drive of the reciprocating pistons may differ from the embodiment disclosed hereinafter. The actual size of the screw conveyor means may also vary depending on the material conveyed by the device. These and many other obvious modifications of the device as disclosed above, however, still fall within the scope of the accompanying claims.

The embodiments of the invention in which an exclusive property or privilege is claimed are defined as follows:

1. Apparatus for feeding a mass of material comprised of solid particles, from an outlet of hopper means to a processing means for processing of said material, said apparatus comprising, in combination:

(a) screw conveyor means for advancing said mass in a generally axial direction away from the outlet of said hopper means, towards an inlet of a tubular conduit, the outlet of said conduit being in a permanent communication with said processing means, said conduit extending generally coaxially with said conveyor means;

(b) an intermediate chamber at the discharge end of said conveyor means, said intermediate chamber being generally coaxial with said conveyor means, being located between said conveyor means and said conduit means, and normally being in a communication therewith;

(c) reciprocating piston means having a forward face end disposed at said intermediate chamber for a reciprocating movement generally coaxially with said screw conveyor means, said forward face of said piston means being turned towards said processing means, said piston means being of the type of an annular piston whose outside diameter generally corresponds to the inside diameter of said conduit, the inside diameter of said piston generally corresponding to the outside diameter of said screw conveyor means, the discharge end of said screw conveyor means being telescopically received inside said annular piston, whereby the portion of the interior of said annular piston between the discharge end of the conveyor means and the face of said piston means forms said intermediate chamber;

(d) first drive means for rotating said screw conveyor means and second drive means for reciprocating said piston means;

whereby said conveyor means is arranged to advance said mass to said intermediate chamber means, while further advance of said mass through said conduit is effected solely by compressive action of said face of the piston means.

2. Apparatus as claimed in claim 1, wherein the conduit comprises protrusion ribs extending longitudinally of the inside wall of an axially limited portion of the conduit and gradually increasing in height in the direction towards said processing means.

3. Apparatus as claimed in claim 2, further comprising means for selectively adjusting the height of said protrusion ribs, to thus adjust the frictional force acting on said mass in the area of said protrusion ribs.

* * * * *